US005628646A

United States Patent [19]

Voss

[11] Patent Number: 5,628,646

[45] Date of Patent: May 13, 1997

[54] ELECTRICAL CORD PLUG RETAINING DEVICE

[76] Inventor: James H. Voss, 26807 N. Woodland Rd., Cleveland, Ohio 44122

[21] Appl. No.: 488,545

[22] Filed: Jun. 7, 1995

[51] Int. Cl.[6] ..... H01R 13/62

[52] U.S. Cl. ..... 439/369; 439/371

[58] Field of Search ..... 439/366–373

[56] References Cited

U.S. PATENT DOCUMENTS

| | | | |
|---|---|---|---|
| 1,065,190 | 6/1913 | Tobin | 439/450 |
| 2,015,404 | 9/1935 | Kiddle | 24/129 D |
| 3,781,761 | 12/1973 | Harwood | 439/369 |
| 3,960,432 | 6/1976 | Wilbur | 439/451 |
| 4,183,603 | 1/1980 | Donarummo | 439/369 |
| 4,773,874 | 9/1988 | Kopeski, Jr. | 439/370 |
| 5,334,042 | 8/1994 | Chevalier | 439/369 |
| 5,336,106 | 8/1994 | Osten | 439/369 |

OTHER PUBLICATIONS

Advertisement for electric cord plug retaining device. Date of publication is unknown but applicant believes such a device was on sale more than a year before the filing date.

*Primary Examiner*—Hien Vu

*Attorney, Agent, or Firm*—Watts, Hoffmann, Fisher & Heinke Co., L.P.A.

[57] ABSTRACT

A plug engagement retainer for retaining engagement of two connected electric cord plugs is disclosed. The plug engagement retainer includes a one piece member being at least in part generally flat wherein the flat part is thinner than it is wide and long. The flat part includes two apertures with each aperture having a large portion and a narrow slot extending from the large portion. The slots extend one toward the other. Portions of the flat part bounding each of the slots are resilient and flexible.

14 Claims, 2 Drawing Sheets

ELECTRICAL CORD PLUG RETAINING DEVICE

FIELD OF THE INVENTION

This invention relates to a device for preventing disengagement of two connected electrical cord plugs.

BACKGROUND ART

A wide variety of portable electric devices are used in commercial and household applications. Examples include electric power tools such as electric drills and saws, electric lawnmowers and hedge trimmers, trouble lights and vacuum cleaners and rug shampooers. Such portable electric devices often have relatively short electric cords and normally are used in conjunction with an extension cord.

A pervasive problem encountered when using a portable electric device with an extension cord is the tendency of the male plug of the device's electric cord to disconnect from the extension cord's female plug as the device is being used. Disengagement commonly occurs when the operator moves the device in a direction away from the extension cord. If all the slack in the cords is taken up, pulling on the device's cord will often result in disengagement of the connected plugs.

To prevent the disengagement of the device's cord from the extension cord during use, a common practice is to tie the two cords together in a simple loop knot adjacent the cord plugs. The plugs are then connected and form part of the loop. During use, it is likely that the device will be moved in a direction away from the extension cord causing the device's cord to pull against the extension cord. Pulling against the extension cord tightens the knot, i.e., the loop becomes smaller, but the plugs are not disconnected.

While tying two electric cords together prevents disconnection of the plug ends, this is not an altogether satisfactory solution to the disconnection problem. Tying the cords necessarily stresses the tied portions of each cord. As the electric device is moved about during use, the knot tightens and further increases the stress on the tied portions of the respective cords. Repeatedly tying an electric cord in this manner will shorten the cord life. Additionally, the knot may be tightened to a point where it is difficult to disconnect the two plugs after the job is finished. Furthermore, as the knot is tightened, the electric device's extending male plug contacts are torqued within the female plug openings. If the torque is sufficient the plug contacts will bend. The male plug contacts may be ruined or, at a minimum, the contacts will have to be straightened prior using the device again. Finally, the loop forming the knot is prone to snagging on obstacles as the electric device is moved about.

A number of designs have been proposed for preventing disengagement or disconnection of two electrical cord plug ends. Most of the designs involve enclosing the connected plugs in a housing. The housing includes interior protrusions which secure the plugs in their connected position even one of the cords is pulled in a direction away from the other cord.

All of the proposed designs have proven less than satisfactory for number of reasons including high cost, lack of durability, the size being too large given the limited space in an average toolbox, difficulty of use, and ineffectiveness.

DISCLOSURE OF THE INVENTION

A plug engagement retainer for retaining engagement of two connected electric cord plugs is disclosed. In its broadest aspects, the plug engagement retainer comprises a one-piece member being at least in part generally flat, the flat part being thinner than it is wide. Two apertures are disposed in the flat part, the apertures each include a larger portion and a slot extending from the larger portion. The slot of each aperture extends towards the other slot.

Preferably, portions of the flat part bounding each of the slots is thinner and more flexible than portions bounding the large portion of each aperture. For each aperture, the slot is approximately equal in length to the dimension of the large portion in the direction the slot extends and a width of each slot is approximately between ⅛th to ½th the length of the slot. For each aperture, a length of the aperture in the direction of the slot is approximately twice as long as in a direction transverse to the slot.

Advantageously, the plug engagement retainer further includes two tabs extending outwardly from opposite ends of the member. The tab portions facilitate holding the retainer while an electric cord plug is inserted through one of the apertures. The retainer is preferably comprised of a single piece of a flexible material such as rubber.

The apertures are sized to define an opening smaller than a cross sectional area of the electric plug to be inserted through the aperture. Thus, for the plug to be inserted through the aperture, the webbing surrounding the slot must spread apart to allow the plug to pass through the aperture. As the plug passes through the aperture, the webbing distorts to allow the plug to pass through the aperture.

When two plugs are inserted through respective apertures and connected, a portion of the webbing partially encircles a segment of the cord, which is received in the slot, just beyond the plug. Further, when the plugs are connected, the cords are angled with respect to the plugs. The overlying webbing and the offset of the cords from the plugs resist disengagement of the plugs.

This and other objects, advantages and features of the invention will become better understood from a detailed description of a preferred embodiment which is described in conjunction with the accompanying drawings.

DETAILED DESCRIPTION

Figure 1:
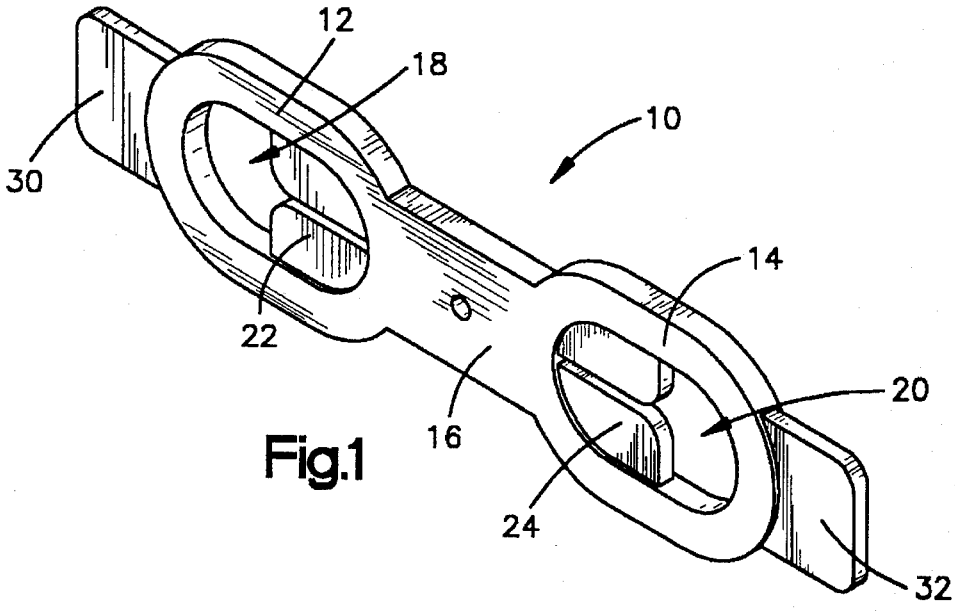
FIG. 1 is a perspective view of an electric cord plug retaining device of the present invention.

Turning to the drawings, an electric cord plug retaining device of the present invention is shown generally at 10. As can best be seen in FIG. 1, the device 10 includes two generally oval-shaped members 12, 14 connected by a waist 16. Preferably, the device 10 is a one-piece unit comprised of molded flexible and resilient rubber and the members 12, 14 and waist 16 are of equal thickness define generally flat top and bottom surfaces. In a direction perpendicular to a longitudinal axis A—A (FIG. 2), the waist 16 is necked down, that is, the waist is preferably narrower than the oval members 12, 14 in the major plane of the device. Although not shown, the waist 16 has a roughened surface to facilitate writing an owner's name and/or other identifying indicia. The waist includes an aperture 17, preferably ⅛" in diameter.

Figure 2:
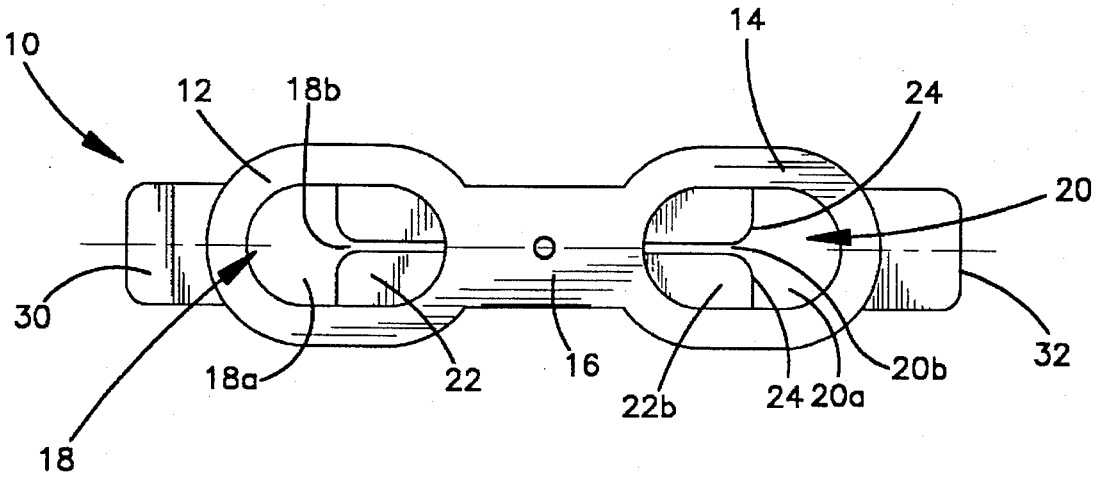
FIG. 2 is a top plan view of the electric cord plug retaining device of FIG. 1.

Turning to FIG. 2, each oval member 12, 14 includes a keyhole shaped aperture 18, 20. The keyhole shaped apertures 18, 20 each include a larger, generally rounded portion 18*a*, 20*a* and a narrower linear slot 18*b*, 20*b* extending from the respective rounded portions. The linear slots 18*b*, 20*b* are aligned and extend one toward the other. Bounding each of the slots 18*b*, 20*b* is a webbing 22, 24. As can best be seen in FIG. 3, a thickness of each webbing is less that a thickness of the oval members 12, 14 for additional flexibility. A width of each slot 18*b*, 20*b* is constant over most of its length but increases adjacent its respective rounded portion 18*a*, 20*a* forming a "Y" shaped throat between each of the rounded portions 18*a*, 20*a* and its respective extending slot 18*b*, 20*b*. The aperture slots 18*b*, 20*b* are each approximately equal in length to the dimension of its respective large, rounded portion 18*a*, 20*a* in a direction the slots extend (that is aligned with the longitudinal axis A—A). Furthermore, for each of the apertures, a width of the slots 18*b*, 20*b* is approximately 1/16", which is approximately between ⅛th and 1/12th the length of the slots. An overall length of each of the apertures 18, 20 in a direction aligned with the longitudinal axis A—A is approximately twice as long a width of the larger, rounded portion of the apertures, that is, in a direction perpendicular to the axis A—A.

Extending from opposite ends of the oval members 12, 14 are gripping tabs 30, 32. As will be explained, the gripping tabs 30, 32 facilitate holding the plug retaining device 10 as electric cord plugs are inserted through respective apertures 18, 20.

Figure 3:
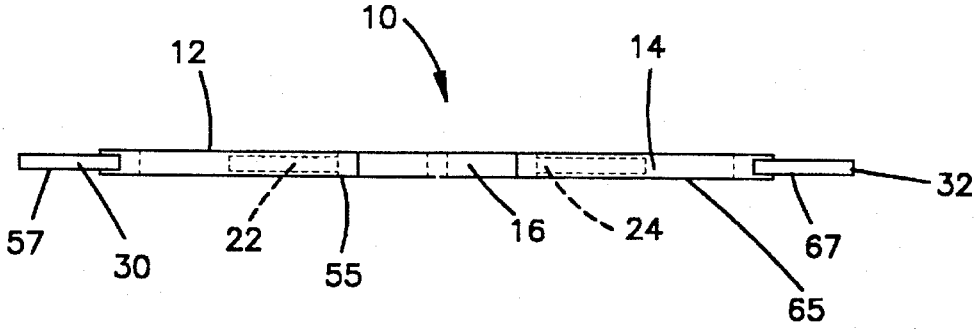
FIG. 3 is a front elevation view of the electric cord plug retaining device of FIG. 1.
Figure 5:
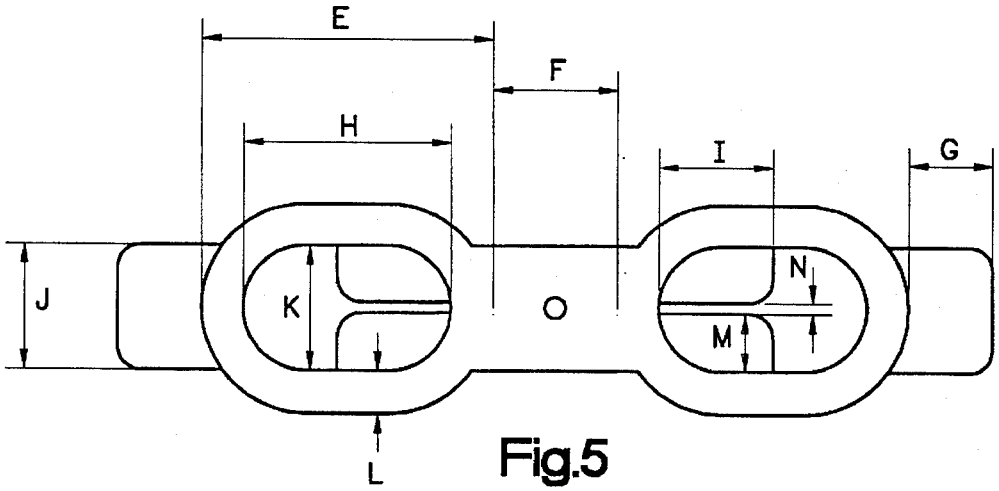
FIG. 5 is the top plan view of the electric cord plug retaining device shown in FIG. 2.
Figure 6:
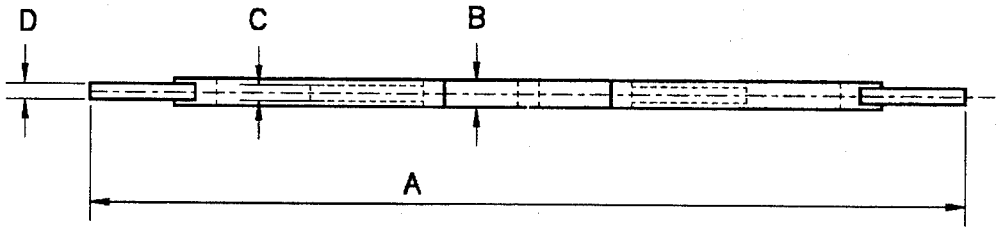
FIG. 6 is the front elevation view of the electric cord plug retaining device shown in FIG. 3.

As can be most easily be seen in FIGS. 3 and 6, a thickness of the webbings 20, 24 is less than the thickness of the oval members 12, 14 and the waist 16. As with the webbings 20, 24, a thickness of the gripping tabs 30, 32 is preferably less than the thickness of the oval members 12, 14. Electric cords vary by gauge size. Generally, the lower the gauge size, the thicker the cross sectional area of the cord. It is envisioned that different sizes of the retaining device 10 will be required to provide the best "fit" for different electric cord gauge sizes. By way of example, typical plug retaining device dimensions are set forth below. The indicated values correspond to the dimensions A–N set forth in FIGS. 5 and 6.

| | 12 Gauge Retaining Device | 14 Gauge Retaining Device |
|---|---|---|
| A | 5 1/4" | 4 5/8" |
| B | 5/32" | 5/32" |
| C | 3/32" | 3/32" |
| D | 3/32" | 3/32" |
| E | 1 3/4" | 1 5/8' |
| F | 3/4" | 3/8" |
| G | 1/2" | 1/2" |
| H | 1 1/4" | 1 1/8' |
| I | 11/16" | 5/8" |
| J | 3/4" | 5/8" |
| K | 3/4" | 5/8" |
| L | 1/4" | 1/4" |
| M | 11/32" | 9/32" |
| N | 1/16" | 1/16" |

Figure 4:
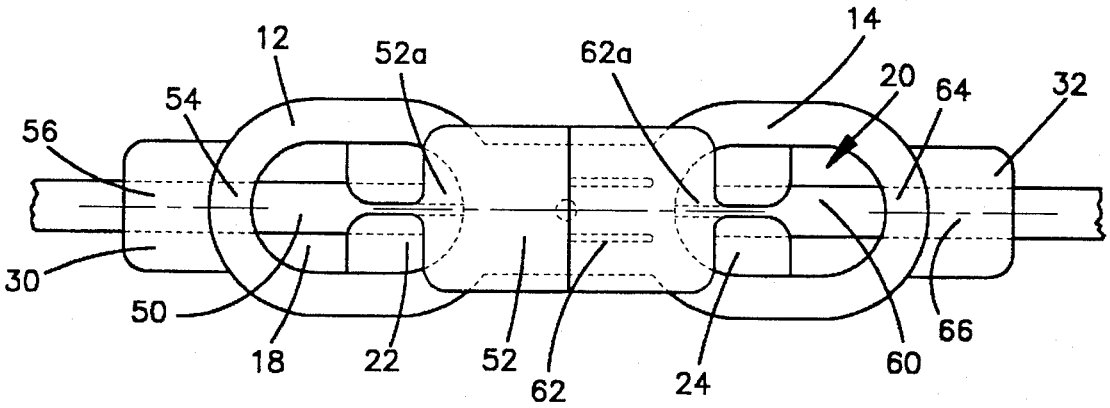
FIG. 4 is a top plan view of the electric cord plug retaining device in use, shown with two connected electric cord plugs.

FIG. 4 illustrates the electric plug retaining device 10 in use. Two electric cords 50, 60 are shown. The cord 50 terminates in a male plug 52, white cord 52 terminates in the female plug 62. The plugs 52, 62 are connected. As can be seen a portion of the webbing 22 overlies a segment of the cord 50 which is adjacent a base 52*a* of the male plug 52. Additionally, the cord 50 is bent at a downward angle with respect to the male plug 52 because a portion 54 (shown in phantom) of a bottom surface 55 (FIG. 3) of the oval member 12 and a portion 56 (shown in phantom) of a bottom surface 57 (FIG. 3) of the gripping tab 30 press against the cord.

Similarly, a portion of the webbing 24 overlies a segment of the cord 60 which is adjacent a base 62*a* of the female plug 62. The cord 60 is bent at a downward angle with respect to the female plug because a portion 64 (shown in phantom) of a bottom surface 65 (FIG. 3) of the oval member 12 and a portion 66 (shown in phantom) of a bottom surface 67 (FIG. 3) of the gripping tab 32 press against the cord.

Assume that cord 50 is attached to a portable electric device (not shown) and cord 60 is an extension cord connected at its other end to a wall socket. An operator may move the portable electric device such that the cord 50 is pulled in a direction P. Assuming that cord 60 is fixed, pulling on cord 50 will result in equal and opposite forces F being exerted on the cords 50, 60. The device 10 will resist disengagement of the plugs 52, 62. The resilient nature of the webbings 20, 24 cause the respective portions of the webbings overlying segments of the cords 50, 60 to the exert a compressive pressure on the cords thereby resisting translational movement of either cord.

Moreover, the encircled segments of the cords 50, 60 are adjacent the base 52*a* of the plug 52 and the base 62*a* of the plug 62 respectively. As can be seen in FIG. 4, these bases 52*a*, 52*a* are of greater diameter than the diameters of the respective cords 50, 60. Thus, these plug bases 52*a*, 62*a* being wider than the cords 50, 60 provide additional resistance to movement of the cords. For disengagement of the plugs 52, 62 to occur, at least one of the wider plug bases 52*a*, 62*a* would have to be pulled at least partially through its respective webbing slit.

Additional frictional forces resulting from the cords 50, 60 pressing against the respective bottom surface portions 54, 64 of the oval member 12, 14 and the respective bottom surface portion 56, 66 of the gripping tabs 30, 32 also resist movement of either cord.

To use the retaining device 10, the operator picks up one of the plugs 52, 62, say for example, plug 52, in one hand and holds one of the gripping tabs 30, 32, say for example, tab 30, between a thumb and an index finger of the other hand. The operator aligns the plug 52 with the aperture 18 of the oval member 12 and pushes the plug through the oval member so that the plug extends beyond the oval member. The aperture 18 is sized to define an opening smaller than a cross sectional area of the electric plug 52 be inserted through the aperture. Thus, for the plug 52 to be inserted through the aperture, the webbing 22 surrounding the slot 18*b* must be spread apart to allow the plug to pass through the aperture 18. As the plug 52 passes through the aperture 18, the webbing 22 distorts to allow the plug to pass through the aperture.

The operator then releases the gripping tab 30 and grips the other gripping tab 32 between his or her thumb and index finger. With his or her other hand, the operator picks up the plug 62 and, as described above, pushes the plug through the aperture 20 so that the plug extends beyond the oval member 14 and is disposed on the same side of the plug retaining device 10 as plug 52. After inserting both plugs 52, 62 through their respective oval member apertures 18, 20, the plugs held by the webbings 22, 24 in roughly parallel positions perpendicular to an upper surface of the oval members 12, 14. The operator then grips one plug in each hand and connects the plugs 52, 62.

Any excess slack between the plugs 52, 62 and the retaining device 10 can be taken up by sliding the device up one or both of the cords 50, 60 so that the webbings 22, 24 abut the respective bases 52*a*, 62*a* of the plugs. If, for example, plug 52 is pushed well beyond the oval member aperture 18, the gripping tab 30 would be grasped and moved parallel to the cord 50 toward the plug 52 thereby sliding the webbing 22 up the cord to abut the plug base 52*a*.

Another use for the retaining device 10 is to maintain one or two plugs in a wall electric outlet (not shown). Most wall electric outlets consist of a fixture having two spaced apart female sockets. Electric wires are connected to terminals on a back side of the fixture. The fixture is covered by a face plate which is which is secured to the fixture by a small screw which extends through a hole in a center of the face plate and threads into an aligned hole in the fixture. The aperture 17 is sized to allow a body of the screw to pass through but abut a head of the screw. To use the retaining device 10 to maintain a male plug in the female socket of the electric wall outlet a wall electric outlet, an operator pushes the male plug through one of the apertures 18,20 of the oval members 12, 14, say aperture 18 of oval member 12. The small screw is unscrewed from the outlet face plate and the plug is pushed into one of the female sockets. The retaining device 10 is then snugged up to the plug base and the screw is pushed through the aperture 17. The screw is then realigned with the face plate screw hole and the threaded hole in the fixture and screwed in thereby securing the retaining device 10 to the face plate and fixture. The webbing 22 resists disengagement of the male plug from the fixture.

While the preferred embodiment for practicing the present invention has been described in detail, it will be apparent that various modifications or alterations may be made therein without departing from the spirit and scope of the invention, set forth in the appended claims.

I claim:

1. A device for retaining two mating electrical plugs together, the device comprising:

a) a one piece member including a flat part having a generally flat top surface and a generally flat bottom surface;

b) the flat part having a thickness between the top and bottom surfaces which is less than a length and less than a width of the flat part;

c) two key hole shaped apertures in the flat part, each of the apertures having a large portion and a webbing with a narrow slot extending from the large portion;

d) said webbing of the flat part bounding each of the slots being resilient and flexible;

e) each slot extending from its respective large portion in a direction toward the other slot, the slots being spaced apart; and f) the flat part being comprised of two generally oval shaped, spaced portions connected by a waist and wherein each oval portion includes one of said two apertures.

2. The device of claim 1 wherein the portions of the flat part bounding each of the slots are thinner and more flexible than portions of the flat part bounding the large portion of each aperture.

3. The device of claim 1 or 2 wherein, for each aperture, a length of the slot is approximately equal to a dimension of the large portion in the direction in which the slot extends.

4. The device of claim 3 wherein, for each aperture, a width of the slot is approximately between ⅛th and 1/12th the length of the slot.

5. The device of claim 1 wherein, for each aperture, the aperture is approximately twice as long in the direction of the slot as it is in a direction transverse to the slot.

6. The device of claim 1 further including two outwardly extending tab portions disposed at opposite ends of said member for gripping the device.

7. The device of claim 1 wherein the member is comprised of rubber.

8. The device of claim 1 wherein an area of each of the apertures is less than a cross sectional area of a electric cord plug to be inserted through the aperture and, for each of the apertures, the large portion is generally rounded.

9. A plug engagement retaining device for retaining engagement of two electric cord plugs, the plug engagement retaining device comprising:

a) a member including two spaced loops connected by a waist;

b) each of the loops defining a key hole shaped aperture having a generally rounded larger portion and a slot extending from the larger portion;

c) the slots extending one towards the other and each slot being bounded by a flexible webbing of the loop, the slots being spaced apart; and d) a tab extending outwardly from an end of each loop that is opposite an end of the loop connected to the waist for gripping the device.

10. The plug engagement retaining device of claim 9 wherein said spaced apart loops and said waist portion are generally planar.

11. The plug engagement retaining device of claim 9 wherein, for each loop, the webbing bounding the slot is thinner and more flexible than portions of the loop bounding the larger portion of the aperture.

12. The plug engagement retaining device of claim 9 wherein, for each aperture, a length of the slot is approximately equal to a dimension of the larger portion of the aperture in a direction the slot extends.

13. The plug engagement retaining device of claim 9 wherein, for each aperture, a width of the slot is approximately between ⅛th and 1/12th the length of the slot.

14. The plug engagement retaining device of claim 9 wherein, for each aperture, the aperture is approximately twice as long in the direction the slot extends as it is in a direction transverse to the slot.

* * * * *